United States Patent [19]

Noren

[11] Patent Number: 4,810,306

[45] Date of Patent: Mar. 7, 1989

[54] LOW ENERGY, LOW WATER CONSUMPTION WAREWASHER AND METHOD

[75] Inventor: Tore H. Noren, Petaluma, Calif.

[73] Assignee: The Stero Company, Petaluma, Calif.

[21] Appl. No.: 833,946

[22] Filed: Feb. 26, 1986

[51] Int. Cl.[4] ..... B08B 9/04

[52] U.S. Cl. ..... 134/25.2; 134/25.4; 134/26; 134/101

[58] Field of Search ..... 134/25.1, 25.2, 25.4, 134/104, 101, 18; 285/41, 238

[56] References Cited

U.S. PATENT DOCUMENTS

| | | | |
|---|---|---|---|
| 2,710,010 | 6/1955 | Lengvenis | 134/57 |
| 2,930,721 | 3/1960 | Tuthill | 134/25 |
| 2,962,048 | 11/1960 | Steidley | 137/565 |
| 3,068,877 | 12/1962 | Jacobs | 134/99 |
| 3,319,651 | 5/1967 | Ullman, Jr. et al. | "/563 |
| 3,465,761 | 9/1969 | Meeker et al. | 134/58 |
| 3,789,860 | 2/1974 | Katterheinrich et al. | 134/104 |
| 3,903,909 | 9/1975 | Noren et al. | 134/101 |
| 4,088,145 | 9/1975 | Noren et al. | 134/101 |
| 4,097,307 | 6/1978 | Geiger | 134/25.2 |
| 4,128,264 | 12/1978 | Oldford | 285/281 |
| 4,147,559 | 4/1979 | Fraula et al. | 134/101 |
| 4,218,264 | 8/1980 | Federighi et al. | 134/58 |
| 4,249,573 | 2/1981 | Chevallier | 137/624.2 |
| 4,277,290 | 7/1981 | Andrews et al. | 134/10 |
| 4,326,551 | 4/1982 | Voorhees | 134/58 |
| 4,366,005 | 12/1982 | Oguri et al. | 134/25.2 |
| 4,439,242 | 3/1984 | Hadden | 134/25.2 |
| 4,561,904 | 12/1985 | Eberhardt, Jr. | 134/25.2 |
| 4,606,775 | 8/1986 | Robinson et al. | 134/25.2 |
| 4,615,944 | 10/1986 | Murtha | 134/25.2 |

FOREIGN PATENT DOCUMENTS

| | | |
|---|---|---|
| 1143980 | 7/1957 | Fed. Rep. of Germany . |
| 2510107 | 3/1975 | Fed. Rep. of Germany . |
| 1628521 | 4/1975 | Fed. Rep. of Germany . |
| 2615846 | 10/1976 | Fed. Rep. of Germany . |
| 2745645 | 10/1977 | Fed. Rep. of Germany . |
| 3020254 | 5/1980 | Fed. Rep. of Germany . |
| 1469338 | 4/1974 | United Kingdom . |

*Primary Examiner*—H. M. S. Sneed
*Assistant Examiner*—Sharon T. Cohen
*Attorney, Agent, or Firm*—Biebel, French & Nauman

[57] ABSTRACT

A commercial warewasher is disclosed, in which racks of soiled ware, such as dishes, are consecutively washed through a machine cycle which includes recirculating wash water over the ware followed by a fresh water spray rinse. A portion of the wash water is drained and a second portion is intentionally retained in the machine during the rinse period after each rack of dishes is washed. The retained portion is thereby combined with the fresh rinse water to provide a volume of water sufficient for pumped wash recirculation for the next rack without cavitation, while enabling usage of a minimum quantity of rinse water required to provide effective rinsing. Reduced water consumption, reduced energy to heat the water and reduced chemical usage (detergents, sanitizers and rinse agents) are all possible in amounts and degrees depending upon the type and design of warewasher with which the method and apparatus is employed.

11 Claims, 4 Drawing Sheets

LOW ENERGY, LOW WATER CONSUMPTION WAREWASHER AND METHOD

This invention relates primarily to a warewasher for washing dishes, utensils, glasses and the like in commercial establishments such as restaurants, particularly "fast food" restaurants, and cafeterias.

BACKGROUND OF THE INVENTION

The terms warewasher and dishwasher may be used interchangeably herein. Further, the term commercial dishwasher (to which this invention is directed), is intended to distinguish from a "domestic" diswasher, the type commonly found in home use. Domestic and commercial dishwashers differ substantially in design and manner of use, with the possible exception of a few commercial machine styles which are an outgrowth of domestic unit designs. Even though these latter designs may appear similar in many respects, they differ in function and operation, not only in the length of time it takes to wash and rinse a rack of ware, but also in the number of washes and rinses per rack. Domestic units ordinarily have the further capability of drying washed dishes within the wash chamber, whereas comparable commercial units feature air drying outside the chamber in order to minimize the time it takes to complete each rack of ware. It is important in a commercial environment to wash racks successively in rapid order. Thus, a commercial washer is used for washing and rinsing but not for drying, because of the length of time it takes for the latter.

Domestic dishwashers may operate as long as 60 to 90 minutes to complete washing, rinsing and drying a single rack of dishes per day, whereas in a commercial establishment, a dishwasher will wash and rinse a rack of dishes in two to three minutes or less and require their immediate removal and replacement with the next rack. The cleansed ware is air dried in the racks, outside the dishwasher. It is rare in a domestic environment to wash consecutive racks or loads of dishes, whereas it is routine in the commercial environment, for example, where an operator may wash one rack after another of dishes during and after a lunch period at a restaurant. Most regular washing cycles of domestic machines include a substantial period for drying in the machine.

In the commercial environment racks of dishes or other ware are successively washed and rinsed in rapid fashion over a very short time cycle for each rack, typically in the order of two to three minutes. The kind of commercial dishwasher to which this invention is applicable is commonly referred to as a "stationary rack machine" i.e., a unit with an enclosable wash chamber in which a rack of dishes is placed, washed, rinsed, and then removed and replaced by a second rack of dishes, while the cleansed rack is air dried outside the chamber. There are two main types of stationary rack dishwashers, one type commonly referred to in the trade as a "fill-and-dump" (hereinafter "fill/dump") machine and a second type which has a large volume tank or reservoir, commonly called a "recirculating" machine, hereafter referred to as a "recirculating" or "tank" machine.

In a fill/dump machine, a single batch of water is typically used for each rack of dishes to be washed, in the following fashion. A sump in the wash chamber is filled with water, detergent added to make wash water, and a rack of soiled dishes placed in the chamber. The wash water is recirculated by a pump through a wash arm or arms having spray nozzles which spray the ware under relatively high pressure to loosen and remove the soil from the dishes. A drain valve is then opened to drain the sump of wash water by gravity into a waste line, usually located in the floor of the restaurant or cafeteria kitchen. The drain valve is then closed and a water line is opened to fill the emptied sump with fresh rinse water. This rinse water is then recirculated by the same pump and wash arm to rinse the ware. Upon completion of rinsing, the rack of rinsed dishes is removed from the chamber, but the rinse water is retained to serve as the wash water for the next rack of dishes, and detergent is typically added either automatically or by hand before the next rack of soiled ware is loaded into the machine.

Although the single batch of water is used as rinse water for one rack and then subsequently used as wash water for the next following rack, the end result (except for the first fill) is that one batch of water is used for each rack of dishes, but the filling and draining of water does not coincide with the beginning and end of a machine cycle. Examples of patents illustrating the type of dishwasher referred to herein are U.S. Pat. No. 4,088,145 issued May 9, 1978 to Tore H. Noren and U.S. Pat. No. 4,218,264 issued Aug. 19, 1980 to George J. Federighi and George B. Federighi. A variation of this type of unit illustrated in U.S. Pat. No. 3,903,909 issued Sept. 9, 1975 to Tore H. Noren and George J. Federighi, in which the batch of fresh water is introduced through the wash system to flush the wash system.

Although each of these patents shows a variety of different designs and functions, they essentially show the basics of a fill/dump machine, namely the recirculation of rinse water through the same instrumentalities that carried the wash water, and subsequently using the rinse water as wash water for the next rack of dishes. With such machines it is necessary to add enough rinse water to serve as the proper volume of wash water for a next rack of dishes. Such machines need to add enough rinse fill each cycle to satisfy the supply, without cavitation, of the pump which circulates the wash water and, in most designs, the rinse water as well. The amount is frequently stated as being at least 1.7 gallons (6.435 liters) of rinse water, but frequently exceeds 2 gallons (7.57 liters) and sometimes is as high as 3 gallons (11.355 liters) per rack.

Quite a different scheme is used in the "recirculating" or "tank" dishwasher. The tank is a relatively large reservoir which is originally filled with as much as sixteen gallons of water and enough detergent is supplied to provide the proper proportion of detergent-to-water for washing. This water or wash liquid is used over and over for washing successive racks with most of the same liquid. The liquid is somewhat diluted with fresh rinse water each cycle. A drain valve is located at the bottom of the tank. The valve is part of an open vertical standpipe which provides an overflow level near the top of the tank. A fresh water spray system rinses the rack of ware at the proper time in a cycle, after it has been washed by pumped recirculation of the large volume of wash water.

A primary purpose for using the tank system is to provide a significant volume of wash water on the dishes, even though that water is reused and tends to get heavily soiled if not watched. The water is typically heated by a heater, and acts as a heat sink to maintain water temperature. A fresh water dedicated rinse is supplied to perform rinsing while the wash recirculation pump is off. By "dedicated" is meant that the rinse system is used to carry only fresh water and not transport soiled wash water. The rinse water descends to the top of the pool of wash water, and a fairly large percentage of the rinse water may overflow through the standpipe and out to the drain. The tank itself is ordinarily drained only every few hours, at which time the water in the reservoir is usually fairly soiled. Strainers are provided to catch any large particles of food or other material washed from the dishes and keep them from reaching the sump wash liquid. Detergent is replenished as needed. To drain the tank, the standpipe is lifted, and in so doing the entire large volume reservoir is drained by gravity into a floor drain.

An example of the type of system described as a tank system is shown in U.S. Pat. No. 4,439,242 issued Mar. 27, 1984 to James P. Hadden. One advantage of the tank system over the fill/dump system is that as little as 1.2 to 1.4 gallons (4.542 to 5.299 liters) of rinse water needs to be used per rack. With the large volume of water available for pumped wash recirculation, rinse water added through the dedicated rinse system can be a minimum quantity required to do an effective rinsing job.

In addition to these primary types of washers, there exists fill/dump machines which utilize fresh water, dedicated rinse systems of a type similar to those used in tank machines. Such machines are completely drained of wash water by gravity directly to a floor drain, and, as will be shown, are incapable of providing the energy and water savings of this invention, without specific modifications to achieve the intended objectives. These fill/dump machines require similar volumes of water per rack as the previously discussed fill/dump machines, to satisfy wash pump needs.

In terms of water temperature, commercial dishwashers are available in what the trade refers to as low temperature and high temperature machines. This simply means that the rinse water temperature in a low temperature machine may be 130°–140° F. (54° to 60° C.) and include a sanitizing agent such as sodium hypochlorite (common household bleach), or, in the case of a high temperature machine, the rinse water has a minimum sanitizing temperature of 180° F. (82° C.) to meet public health standards in the United States. It should be understood the the invention disclosed and claimed herein is useful in either low temperature or high temperature machines if the objective of obtaining water and/or energy savings is achieved.

SUMMARY OF THE INVENTION

The invention provides what may be considered a hybrid type of warewasher which employs certain of the advantages of a fill/dump unit without necessitating use of as much water and energy, and also is capable of having the water and energy savings advantages of a tank machine. It functions in certain respects like a tank machine, but uses cleaner wash water and avoids loss of any of the freshest and hottest water to a drain, as happens to some extent in a tank machine. The latter features are attributes of a fill/dump machine.

For an understanding of the functioning of a machine according to the invention, certain requirements of a stationary rack commercial dishwasher should be addressed first, primarily as an example, and not a limitation.

A typical recircul,ation pump for the wash system requires a minimum of about 1.5 gallons (5.678 liters) of water in the sump to prevent pump starvation due to cavitation. But 1.5 gallons is not only borderline in the amount of water that needs to be recirculated onto the ware to do an effective washing job, it also fails to recognize that much water is out of the sump during wash recirculation. For example, the recirculating wash pump disclosed herein delivers 60 gallons of water per minute (227 liters/min) through a pair of wash arms and tubing connected thereto. The tubing and the arms themselves hold a substantial proportion of the 1.5 minimum gallons required. That, coupled with the facts that spray is suspended in the chamber and water must drip from the dishes and sides of the wash chamber, 1.5 gallons is ordinarily insufficient to supply a pump having such a large flow capacity. Fill/dump machines of the type which have been described above utilize anywhere from 1.7 to about 3 gallons of water in order to satisfy the washing requirements of the wash system.

To provide the larger volume of wash water according to the invention, there is a deliberate retention of a portion of the wash water by preventing it from going to the waste line or drain upon completion of washing. While this is unsatisfactory for good rinsing results in most fill/dump machines known heretofore, retention of wash water at the end of a wash portion of a cycle permits an operation of what appears to be a fill/dump design of dishwasher in a manner somewhat like a recirculating tank-type system. This necessitates, however, the use of a dedicated fresh water rise system, which is standard in many machines. But due to retention of some wash water each cycle the invention can accomplish both effective washing and rinsing with less water and energy usage.

In a preferred form, the invention involves retention of some wash water by preventing its being drained at the end of the wash portion of a cycle. A drain pump pumps out the sump water to a waste line which is located at a higher level than the sump in one form of the invention. In many fast-food establishments, the kitchens are relatively small in comparison to those found in cafeterias and restaurants, where floor drains are commonly provided. Such fast-food kitchens have sinks and traps which are typically located above floor level. Clearly, the gravity drain machines are not usable as a practical matter in such a kitchen. By designing a fill/dump type machine for low, undercounter use and pumping drain water from the sump to a higher level drain, it is readily feasible to avoid or prevent pumping out all of the drain water. This retained water, though soiled, can be added to the fresh water which is supplied by dedicated rinse nozzles for rinsing the ware, and thus become a larger volume of wash water for the next rack of ware.

In so doing, it is possible to use less water for rinsing, on the order of 1.5 gallons (5.678 liters) per rack, collecting another 0.75 to 1 gallon (2.839 to 3.785 liters) of water via retention from the previous wash, and thus having almost 2.5 gallons (9.463 liters) of water available for pumped recirculation for the next wash. That 2.5 gallons is adequate to supply the wash pump without cavitation, and in so doing, allows less water to be used for rinsing. This saves not only water, but also the expense of energy and detergents (and sanitizing chemicals in the case of a low temperature machine) since their proportions are necessarily related to the amount of water used per rack. In essence, in this preferred design, although 1.5 gallons of water is added to each cycle by rinsing, the wash recirculating pump is performing with perhaps 2.5 gallons (9.463 liters) of water, quite adequate to satisfy its needs to do an effective washing job.

In a second preferred form of the invention, water is retained from the drained wash water where gravity draining to a floor drain is possible. The retention means may be part of the mechanical design, a timed gravity drain period to close the drain while an approximate predetermined portion is retained or any other manner of achieving a desired controlled retention. It should be recognized that the quantity of wash water retained may vary in either form of the invention provided the desired objective of reduced water consumption is achieved.

It is recognized that in domestic or home dishwashers, practically all of which pump to a drain at a higher level than the dishwasher sump, some drain water will be retained from each batch. The amount of water retained is due to being unable to fully pump all of the water out of system which pumps to a level higher than the pump. The amount of water retained in the sump at the end of a complete wash, rinse and dry cycle is known in some designs to be in the order of 0.5 to 1 cup (119 to 237 ml). But that water does not serve any function of enabling reduction of water and energy for the next rack, the next day. In a domestic system, there may be two or three fresh water rinses added to the sump, recirculated and pumped out. Thus, the final rinse water is quite clear. On the contrary, in the present invention, the retained water is soiled. But that is absolutely harmless, because it will be used subsequently only as wash water and not rinse water, much like in the tank system previously described. To the extent that certain commercial dishwasher designs are patterned after a domestic design, a small volume of wash water may be retained in the sump, but, if anything, it is detrimental and therefore kept to the minimum possible. The detriment exists because that retained wash water is soiled and should not be recirculated as rinse water through the pump and wash arms.

The primary object of the invention, therefore, is to provide a method of operating a commercial dishwasher having a cycle of operations which includes a wash period using recirculated wash water and a rinse period using fresh rinse water from a dedicated rinse system, in which a first portion of soiled wash water is drained while a second portion of the wash water is retained for use in washing during the next cycle, then collecting the fresh rinse water in the machine along with the retained wash water, the volume of rinse water and duration of rinsing being an approximate minimum to perform effective rinsing; to provide a method wherein the total retained wash water and collected rinse water combining in the sump provide, for a next following rack of ware, a wash water volume which is substantially in excess of that supplied by the rinse system alone; to provide such a method wherein the retained quantity of wash water is at least 25% of the total volume of wash water used each cycle; and to provide a novel commercial dishwasher in which a recirculating pump, wash arms and dedicated rinse nozzles are operated such that at the end of a wash period a predetermined quantity of wash water is retained in the machine, for addition with rinse water subsequently issuing from the rinse nozzles to provide a combined quantity of water in said machine for washing during the wash period of a subsequent cycle, thereby enabling usage of a quantity of water for rinsing each rack of ware which is adequate to provide satisfactory rinsing while enabling the volume of rinse water for each rack to be maintained at an approximate minimum to conserve energy and water.

Other objects and advantages of the invention will be apparent from the following description, the accompanying drawings and the appended claims.

DESCRIPTION OF THE PREFERRED EMBODIMENT

Figures 1, 5:
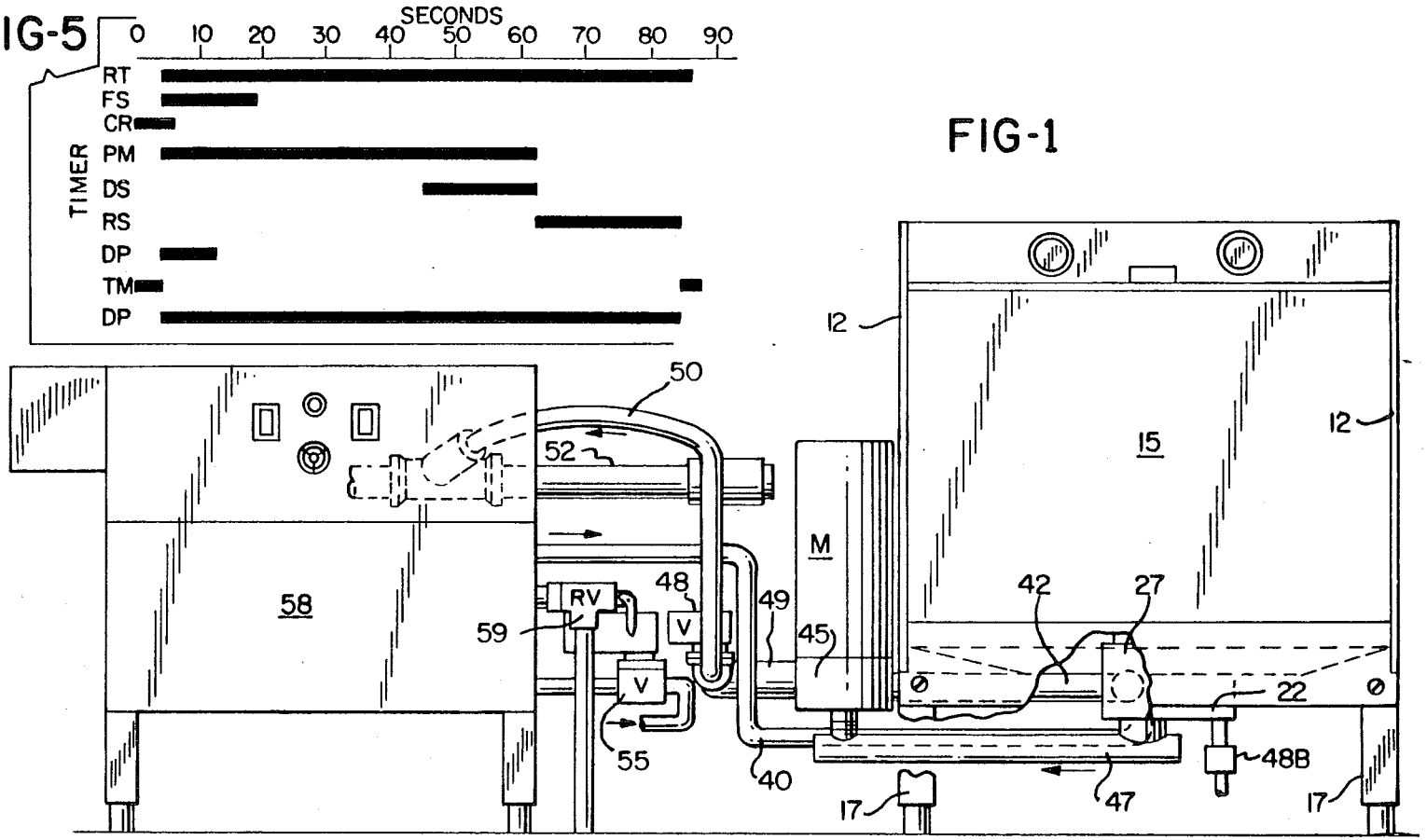
FIG. 1 is a frontal view of an undercounter commercial dishwasher incorporating the features of the invention, and including an optional preheating water tank.
FIG. 5 is a timing diagram for the timer shown in the electrical diagram.
Figure 2:
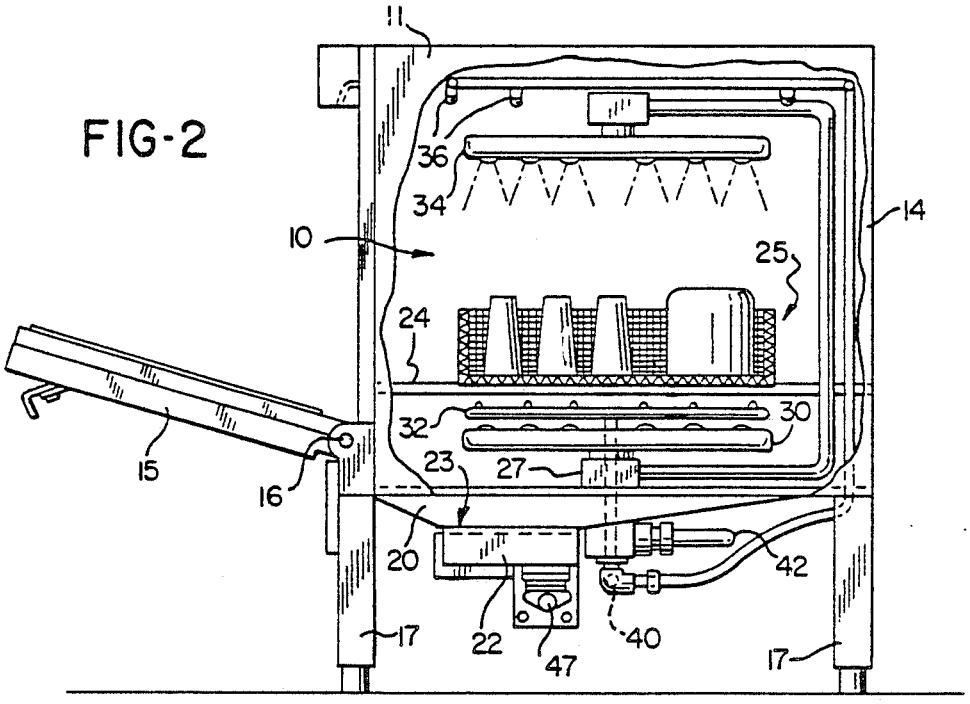
FIG. 2 is a side view of the dishwasher shown in FIG. 1, with part of the cabinet broken away to show details of the wash and rinse systems and associated plumbing.

With certain exceptions which will be noted, the basic components of a dishwasher incorporating the present invention are known. Referring to FIGS. 1 and 2, the dishwashing machine includes a washing/rinsing chamber 10 which is defined by a cabinet, usually formed of stainless steel panels and components, and including a top wall 11, side walls 12 and rear wall 14, and a front facing door 15, hinged at its lower end, as indicated at 16. The chamber 10 is vented to ambient pressure through labyrinth seals (not shown) near the top wall. The cabinet is supported upon legs 17 which provide the necessary clearance for the underside of the machine to permit cleaning beneath it as required by various local sanitation codes. At the bottom of the chamber, as part of the sloping bottom wall 20 of the cabinet, is a relatively small sump 22 which may have a removable strainer cover 23. It is possible that a large plumbing elbow can serve the function of a sump because of the use of an outlet pipe or tube extending therefrom, as described below.

Above the bottom wall, rails 24 provide support for standard ware racks 25, loaded with ware to be washed and sanitized, which are loaded and unloaded through the front door. A coaxial fitting 27 is supported on the lower wall 20, centrally of the chamber, and this fitting in turn provides support for a lower wash arm 30 and lower rinse arm 32, each of conventional reaction type. An upper wash arm 34 and upper rinse spray heads 36 are supported from the top wall of the chamber.

The fresh hot rinse water supply line 40 extends from a source of hot water (to be discussed later) and is connected to the rinse arm 32 and rinse spray heads 36. The wash water supply line 42 is connected to the upper and lower wash arms 34 and 30, and receives wash water from a pump 45 mounted to one side of and exterior of the cabinet. The pump in turn is supplied from an outlet pipe 47 that extends from sump 22 and returns or recirculates the wash water sprayed over the ware in the rack during the wash segment of the machine cycle. The volumetric capacity of sump 22 and outlet pipe 47, along with the height location of the inlet or eye of the impeller in drain pump 45, which is preferably a centrifugal pump with a direct motor drive, mounted in inverted fashion as shown, are important to the features of the invention, and are described in greater detail in connection with later description of the machine operating cycle. Thus, during the wash portion of an operating cycle, pump 45 functions as a recirculating pump means.

Figure 3:
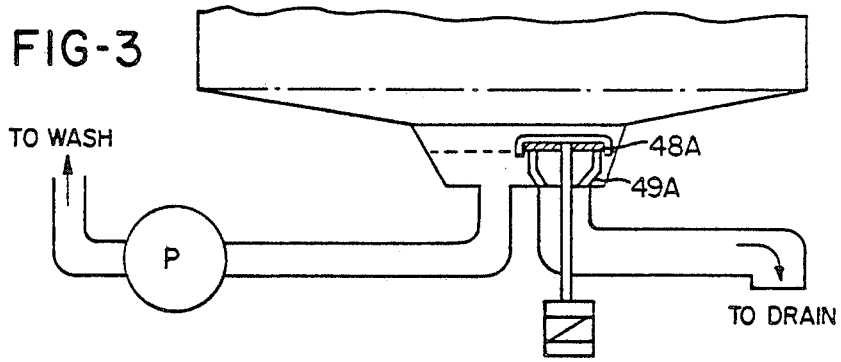
FIG. 3 illustrates a modification using a gravity drain.

A solenoid operated drain valve 48 is connected by a branch or drain pipe 49 to the wash water supply line 42 immediately downstream of the outlet of pump 45, and this valve when open allows flow of the pump discharge to a drain line 50 that may be connected into a suitable kitchen drain system 52, according to the applicable code regulations. In many kitchens in newer fast food restaurants the drain system may be considerably above the floor, thus the pumped discharge from the dishwasher is a desired feature in those installations. Also, when the drain valve is open, the path of least resistance to the pump output is through drain valve 48, and flow through the recirculating wash plumbing quickly diminishes due to back pressure created at the nozzles of the wash arms. At this time the pump 45 functions as a drain pump means. During the normal cycle of operations of this machine, as later described, drain valve 48 is opened once each cycle of operation, after the wash segment and before the rinse segment of the cycle. Alternatively as shown in FIG. 3, a solenoid-operated valve 48A, atop a small standpipe 49A in the sump, can be used to gravity drain the chamber to the desired retained volume, and lifting the standpipe can drain the machine at shut down where a floor drain is available and the drain pump means feature is not needed.

A solenoid-operated fill valve 55 is connected, in the embodiment shown, to control the supply of fresh water to a booster heater 58, which is a displacement type heater tank having its inlet connected to receive water through fill valve 55, and its outlet connected to the fresh rinse water supply line 40. The booster heater has a heating element with a capacity of (typically) 6 kW, and has the usual pressure relief valve 59 which will divert hot water through an overflow pipe in the event the tank pressure exceeds a predetermined value. In the usual case, the booster heater operates at water line pressure, which normally is about 60 to 90 psig.(4.219 to 6.328 kg/cm$^2$ gage) and supplies water at 180° F. (82° C.) or above in accordance with NSF (National Sanitation Foundation) regulations.

The booster heater can be omitted if a source of 180° F. water is otherwise available, in the case of a high temperature machine, or if lower temperature rinse water is used together with a sanitizing agent, e.g. in a low temperature machine. In those cases the fill valve 55 is simply connected from the supply into the rinse water supply line 40 and the water supply temperature may be in the order of 140° F. (60° C.).

Also, a low capacity (e.g. 500 W) heater may be fitted to sump 22. Such a heater may be, for example, a wire or similar heating strip embodied in an elastomeric pad that can be adhered to the exterior of the sump to heat water in the machine by conduction, if necessary. An optional auxiliary drain valve 48B can also be connected into the bottom of sump 22 to permit total draining of the sump at the end of a period of use, if this feature is desired. However, as will be seen, any water retained in the sump 22 and outlet pipe 47 is essentially fresh rinse water that has been sprayed once over the ware in the machine and then collected. Thus this water, especially in the small retained quantity according to the invention, could be retained for a considerable period without concern.

Machine Operating Cycle

Referring to FIG. 5, which is a cycle timing chart, an explanation of the operating cycle assumes that the machine has been filled initially, that a loaded rack of soiled ware is in the wash chamber, the drain valve is closed, and the door is closed. An appropriate charge of detergent is added to the water, either manually before the door is closed or automatically when the door is closed and this action is detected. Preferably the control proceeds through a short reset term of a few seconds. Then the pump 45 is started and wash water (detergent added) is recirculated through the wash arms onto the ware, draining back to the sump and to the pump inlet, with pump 45 functioning as a recirulating pump means. This segment of the cycle continues for about forty-one seconds, then the drain valve 50 is opened and the pump continues to run, discharging wash water to drain.

After a period of about seventeen seconds, the pump is stopped. During that time, the pump discharges about 1.5 gallons of the wash water before the pump begins to cavitate, and retains 0.8 gallon. When the drain valve is opened, water pressure to the upper and lower wash arms is reduced, flow through them deceases, and the wash arms and their associated plumbing will drain by gravity to the lowest point, which is the nozzles of the lower wash arm, when the pump stops. In the meantime, pump 45, now functioning as a drain pump means together with the open drain valve, discharges wash water until the level of water in sump 22 and the associated outlet pipe 47 reaches the level of the pump impeller eye, at which time the pump begins to cavitate and effectively ceases to pump water. Thus the 0.8 gallon of retained wash water is made up of whatever remains in the outlet pipe and sump at this time, plus whatever drains from the wash water plumbing after the pump stops.

A short dwell period of about two seconds follows, after which the fresh water fill valve 55 opens and fresh hot rinse water is supplied to the rinse arm 32 and spray heads 36 under supply pressure. This flow continues for about twenty-two seconds, which is sufficient to thoroughly rinse and sanitize the ware in the case of a high temperature machine. In the case of a low temperature machine, sodium hypochlorite (or other sanitizing agent) may be injected into the flow of rinse water, in known fashion. The amount of fresh rinse water added during this period is 1.5 gallons. The fill valve is then closed, a dwell period of about three seconds preferably follows during which the rack of ware drains and the fresh water plumbing drains down to the level of the nozzles in the lower rinse arm, and the rack of cleansed ware is unloaded. The sump contains a full charge of 2.3 gallons, which is retained and has detergent added to it to serve as wash water in the next cycle.

The Control System

Figure 4A:
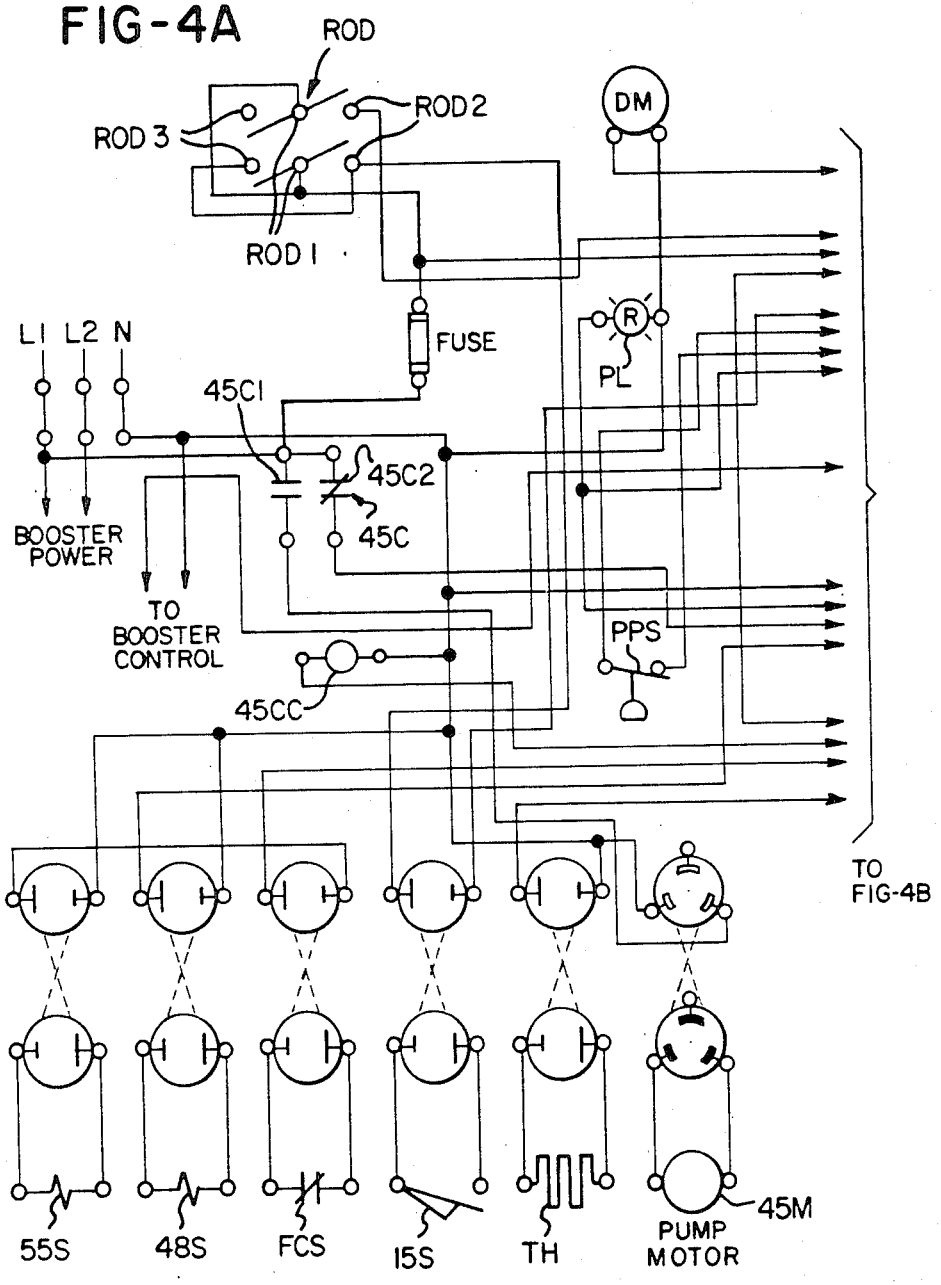
FIGS. 4A and 4B are, together, a schematic electrical control circuit.
Figure 4B:
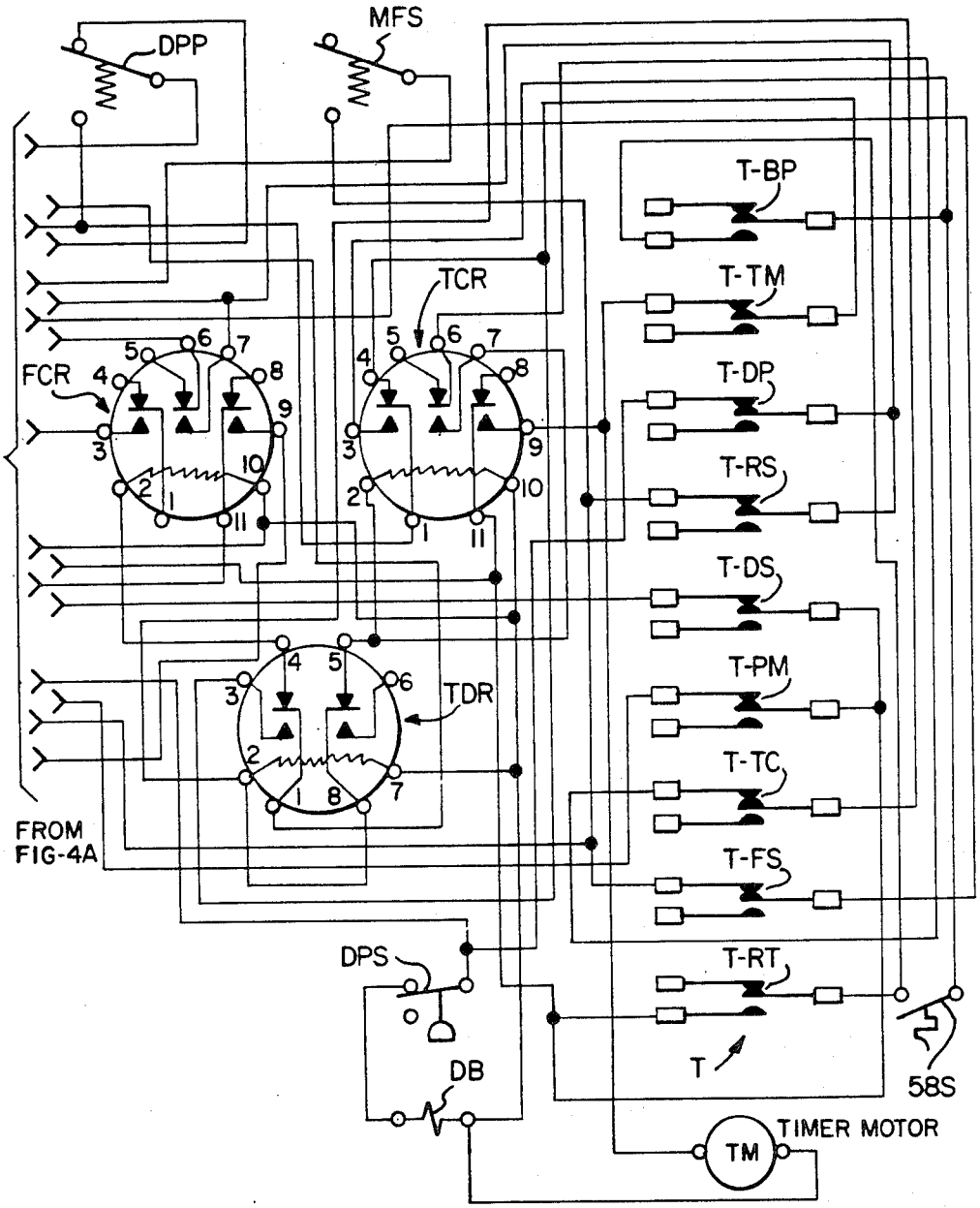

Referring to FIG. 4, which is a wiring diagram for a high temperature machine incorporating the invention, and using a related booster tank 58 as shown in FIG. 1, reference numerals with appropriate suffixes are used to relate the controls to parts of the machine. Thus, the pump motor is identified as 45 M, its control contactor as 45 C, and the contactor coil as 45 CC. The door 15 operates a door switch 15 S which is open when the door is open, closed when the door is closed. The solenoid for the fill valve is 55 S, the drain valve solenoid is 48 S, and the temperature sensor switch for the booster heater is 58 S. The circuit incorporates three relays, the fill control relay FCR, the timer control relay TCR, and a shut down time delay relay TDR which functions to shut down the heaters if the machine has not been run through an operating cycle for a predetermined time. A motor driven cam operated timer T has a drive motor TM and plurality of cam operated switches, later identified, which sequence the machine functions.

There is a normally closed pump pressure switch PPS which is physically located (not shown) at the output of pump 45, and a fill cut-off or over-fill switch FCS which has a conventional proximity detector device (for example float operated) that will open switch FCS when the level of water in the bottom of chamber 10 exceeds a predetermined level. The heater element TH is for the low capacity tank heater previously mentioned. A conventional detergent dispenser (not shown), for example in the form of a peristaltic pump device, is actuated by a detergent pump motor DM, and has a normally closed pressure switch DPS connected to its output, so the switch will open if the pump is driven and it feeds a quantity of detergent as required. An audible warning device (e.g. a buzzer) DB can receive power through switch DPS if no detergent output is detected, to warn the operator to refill the detergent dispenser, and a priming control switch DPP for the motor DM is provided, normally spring loaded to the position shown at the top of FIG. 4. A normally open manually operated fill switch MFS is also provided for initially over-riding the timer control of fill valve solenoid 55 S when the machine is first started up.

Power is supplied at the service connections which are labeled N and L1. Line L2 is part of a higher voltage supply to the booster heater. A three position manually operated switch ROD (run-off-drain) is provided to initiate machine operation, and it is also indicated on FIG. 1 at the top front of cabinet 10. Switch ROD is shown in its off position; in its run position its common or central contacts ROD-1, which are connected via the fuse to service L1, will be closed on the run contacts ROD-2; the contacts ROD-3 are normally open, but will engage contacts ROD-1 in the drain positon of the switch, when it is desired to drain the machine.

With the control circuit connected to the service lines, power is available from line L1 to connection FCR-11 of relay FCR through the normally closed contacts 45C-2 of the contactor 45C, and to the normally open contact of switch DPP, to connection TCR -1 of the relay TCR and through that relay to its connection TCR-4 and thence to open connection TDR-3 of relay TDR, and also to the common connection of timer switch T-TM.

This supplies power to timer motor TM, since it is also connected to the service line N, and the timer advances until its switch T-TM opens and its switch T-RT closes. The operator can at this time have the door open and be loading a rack of soiled ware into the chamber. The relay TCR is energized and transfer its contacts once the door switch 15 S is closed, power going to the coil of relay TCR via the closed door switch and the time delay relay TDR through its connections TDR-8 and TDR-5 to TCR-2. Power is applied to the run indicator or pilot light PL, via TCR-4 and 11. At the same time relay TDR is energized, but its delay period is substantial, for example one hour, so its connections remain as shown. Each time the door switch is opened and again closed, this action resets the relay TDR to begin a new delay period, so relay TDR never transfers until the door switch 15 S remains closed for the time period of the delay relay.

Moving switch ROD to its run position closes its contacts ROD-2, and this energizes relays FCR and TCR. Power is supplied to connections FCR-1 and 2 of the fill control relay through the run switch contacts ROD-2, time delay relay connections TDR- 1 and 4, thus relay FCR transfers its contacts upon closing switch ROD to its run position. This supplies power via connections FCR-9 and 11 to the tank heat element TH, and via connections FCR-1 and 3 to the control for the booster heater in the booster tank. Power is also available at the common connection of timer switch T-RT, via connections TCR-1 and 3, once the temperature sensor switch 58 S is closed, but this will not happen until the water in the booster heater reaches a predetermined high temperature, sufficient to assure 180° F. rinse water when needed. When the booster tank is ready, power will again be supplied to the timer motor via connections TCR-11 and 9.

The timer closes its switch T-FS, and this supplies power to fill valve solenoid 55 S, provided the over-fill control switch FCS is closed. Opening the fill valve allows fresh water to enter the booster heater tank, displacing the hot water into the machine. The timer switch T-PM then closes, energizing the contactor coil 45CC and contactor 45C completes a circuit through its normally open contact 45C-1 to the pump motor 45 M. The pump will run during this portion of the fill period, and when there is sufficient water for the pump to reach its predetermined pressure, the normally closed pressure switch PPS will open, deenergizing the fill valve solenoid 55 S. During this period, the timer switch T-DP closes long enough to energize the detergent pump motor DM, and a dose of detergent is added to the water in the chamber. The pump is now recirculating wash water or liquid through the upper and lower wash arms and back to the sump and the pump inlet. This wash period will continue for approximately sixty-six seconds from the opening of the fill valve. During this interval timer switch T-FS has opened and the timer switch T-DS now opens, energizing the drain valve solenoid 48 S.

With drain valve 48 open, pump 45 functions as a drain pump means and the wash water exits through the drain pipe 50. Pressure in the pipes leading to the wash arms drops and flow through them diminishes. As the sump 22 empties, the outlet pipe or conduit 47 begins to pass air to the eye of the pump impeller, it begins to cavitate, and the drain period effectively ceases, although the motor 45 M may still operate for a few seconds. The term of the drain period, i.e. drain valve open, may be in the order of 17 seconds, after which timer switch T-DS opens and the drain valve 48 closes, and the timer switch T-PM opens to stop the pump motor 45 M. Remaining in the chamber is the wash water still in pipe 47, plus whatever water drains by gravity at this time from the wash arms, down to the level of the nozzles in the lower wash arm 30. The volume of this retained wash water can be (as previously explained) in the order of 0.75 to 1 gallon (2.839 to 3.785 liters).

The cycle proceeds, and timer switch T-RS closes, thus energizing fill valve solenoid 55 S (assuming the draining has proceeded properly and the over-fill switch is still closed). Fresh water again is admitted to the booster heater. At this time the timer switch T-BP closes to shunt the booster heater sensor switch 58 S, lest it should open due to the extended admission of colder water to the booster heater tank. The timer switch T-RS remains closed for a sufficient rinse period, about twenty two seconds, allowing hot rinse water to spray through the rinse system and over the cleansed ware. The rinse water collects in the sump 22 and bottom 20, approximately 1.5 gallons (5.678 liters) along with the retained wash water. When the rinse valve is opened, upon opening of timer switch T-RS, there follows a short dwell period of about three seconds, after which the timer switch T-RT opens, the timer switch T-TM closes but, power to its common connection is not available since relay TCR is still energized and connections TCR 1 and 4 are open. The timer motor stops, and pilot light PL is extinguished, indicating the cycle is complete. The door 15 may then be opened, the rack of clean ware removed, a rack of soiled ware loaded, and the door closed, upon which the cycle will repeat. Opening door switch 15 S deenergizes relays TCR and TDR, thus power is applied through TCR 1 and 12 to timer switch T-TM to reset the timer. If the booster temperature is high enough, opening T-BP will not matter because 58 S will be closed.

Should the door remain closed for an extended period, as if the machine is left unattended, or use has stopped and a rack of soiled ware was not loaded, the relay TDR will time out and transfer its contacts. This will open the power supply to the tank heater element TH and also denergize the booster heater control circuit.

Figure 6:
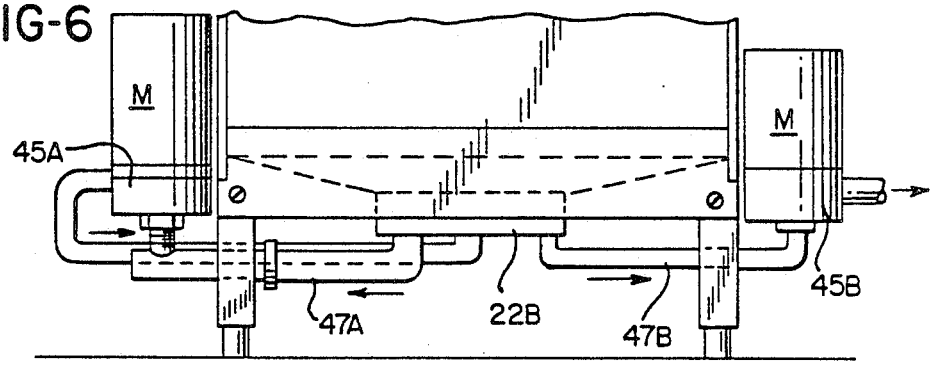
FIG. 6 shows a modification using separate recirculating and drain pumps.

FIG. 6 shows a modification employing separate pumps for recirculating wash water and for draining (pump out). The sump 22A has a drain tube or pipe 47A leading to a motor driven recirculating pump 45A which merely returns wash water to the wash arms. A separate drain tube 47B also extends from the sump, leading to the inlet of a motor driven drain pump 45B, the outlet of which can be connected to a suitable waste line. In this embodiment, when the wash period nears its end, the pump 45A is stopped, and pump 45B is then run to withdraw wash water from the sump 22A. This continues until the wash water level is lowered to the point where tube 47B enters the sump (a short standpipe connected to tube 47B above the bottom of the sump, can be included if it is desired to retain more wash water). At this time, no more water can be pumped out due to cavitation of the drain pump 22B, but retained wash water remains in the tube 47A leading to pump 45A. This arrangement requires an extra motor driven pump and some extra plumbing, but eliminates the need for a solenoid-operated drain valve, and can be part of an "add on" arrangement for a gravity drain type of machine as described in connection with FIG. 3.

While the method herein described, and the forms of apparatus for carrying this method into effect, constitute preferred embodiments of this invention, it is to be understood that the invention is not limited to this precise method and forms of apparatus, and that changes may be made in either without departing from the scope of the invention, which is defined in the appended claims.

What is claimed is:

1. The method of washing and rinsing consecutive racks of ware in a total cycle time on the order of three minutes or less per rack, comprising the steps of:

placing a first rack of soiled ware in an enclosable wash chamber, introducing a predetermined quantity of water into the chamber to enable continuous recirculation of the water over the soiled ware by means of a pump to strip soil from the ware, introducing a detergent medium into the sump water to produce a wash liquid, then recirculating the wash liquid over and onto the ware to clean the ware, discontinuing wash liquid circulation and draining a first portion of soiled wash liquid while retaining a second portion of the wash liquid for use as wash liquid in the next cycle for washing a different rack of ware, rinsing the washed ware with a pressurized rinse spray from a rinse system connected and dedicated to a fresh water supply and collecting the rinse water with the retained wash liquid, removing the rack of rinsed ware from the chamber and placing a second rack of soiled ware in the chamber, and repeating the foregoing steps using as wash liquid the combined retained wash liquid and fresh rinse water.

2. The method according to claim 1 wherein draining is accomplished by pumping the first portion of wash liquid to a waste line located at a level above the pump.

3. The method accoding to claim 2 wherein recirculating and draining are accomplished by a common pump means.

4. The method according to claim 1 wherein draining results from opening a drain valve to permit the chamber to drain by gravity.

5. The method according to claim 4 wherein the drain valve is above the bottom of a sump located in a bottom wall of the chamber to inhibit draining from the sump of liquid below the drain valve.

6. The method according to claim 1 wherein said retained portion of wash liquid comprises at least 25% of the wash liquid used for recirculation during washing.

7. The method of washing ware in a warewasher having (a) an enclosable wash chamber;

(b) a wash system including a sump for collecting water at the bottom of the chamber, recirculating pump means having an inlet connected to the bottom of said sump, and at least one wash arm having a plurality of wash nozzle orifices for pressurized spraying of ware in a rack placed in the chamber and being mounted for ratation in reaction to water sprayed from the nozzle orifices;

(c) a rinse system comprising a supply of fresh water under pressure, a plurality of rinse nozzles in fluid communication with said supply and located above and below said ware, and fill valve means intermediate the fresh water supply and the rinse nozzles; and (d) a drain system including drain pump means having an inlet and an outlet, a line form the outlet of the drain pump means to a waste line located at a higher elevation than the water level in the sump, the inlet of the drain pump means being in fluid communication with the bottom of the sump, and normally-closed drain valve menas intermediate the sump and the waste line; said method comprising the steps of:

initially filling the sump with water to a normal static fill level substantially above the inlet to the recirculating pump means, placing a first rack of soiled ware in the chamber, recirculating the wash water for a predetermined period to strip soil from the ware, opening the drain valve means and operating the drain pump means to cause water to flow to the waste line until the wash water level descends to the bottom of the sump and air is entrained into the drain pump means to cause drain pump means cavitation, continuing recirculation of wash water during draining to maintain water in the wash system, discontinuing pumping and closing the drain valve means to drain the wash system to the level of the nozzel orifices, then opening the fill valve means for a minimum volume of fresh water adequate to thoroughly rinse the ware and upon completion of the rinse period draining the rinse system in to the sump to the level of the lower rinse nozzles, the water received from draining of the wash system and from rinsing combining in the sump to return the water level approximately to the normal static fill level and thereby to provide for a next following rack of ware a wash water volume which is substantially in excess of the water supplied by the rinse system alone, removing the rack of washed and rinsed ware from the chamber and replacing it with a second rack of soiled ware, and activating the recirculating pump means to recirculate the combined retained water to wash the ware in the second rack.

8. The method according to claim 7 wherein the wash recirculation and the draining are performed by a common pump means.

9. The method according to claim 7, wherein the wash circulation and the draining are performed by separate pumps.

10. The method according to claim 7 wherein said wash system includes a pair of wash arms located above and below the rack of ware to be washed to direct recirculated wash water both upwardly and downwardly toward the ware, and wherein the recirculating pump means maintains water in both wash arms while the drain pump means is operating.

11. The method according to claim 9 wherein the wash recirculation and the draining are performed by a common pump means, wherein the drain valve means is located intermediate the common pump means and the waste line, and wherein wash water is pumped to drain upon opening of the drain valve means in response to back pressure created between the common pump means and the wash arms.

* * * * *